United States Patent [19]

Nielsen et al.

[11] Patent Number: 4,885,964

[45] Date of Patent: Dec. 12, 1989

[54] TAPE SLITTER ADJUSTMENT MEANS

[75] Inventors: Christian M. Nielsen; James C. Bolton, both of Ojai, Calif.

[73] Assignee: Industrial Tools, Inc., Ojai, Calif.

[21] Appl. No.: 650,430

[22] Filed: Sep. 14, 1984

[51] Int. Cl.[4] ..... B26D 1/24

[52] U.S. Cl. ..... 83/56; 83/425.3; 83/504; 83/506; 83/676

[58] Field of Search ..... 83/502, 504, 342, 345, 83/545, 479, 480, 498, 499, 675, 676, 56, 425.3, 509, 430, 434

[56] References Cited

U.S. PATENT DOCUMENTS

| | | | |
|---|---|---|---|
| 469,543 | 2/1892 | Cook | 83/504 |
| 2,706,524 | 4/1955 | Hall | 83/503 X |
| 3,606,811 | 9/1971 | Hallden | 83/342 X |
| 4,428,265 | 1/1984 | Bolton | 83/502 |
| 4,559,855 | 12/1985 | Schieck | 83/425.3 |

*Primary Examiner*—Frank T. Yost
*Assistant Examiner*—Hien H. Phan
*Attorney, Agent, or Firm*—Kelly, Bauersfeld & Lowry

[57] ABSTRACT

A tape slitter has a pair of parallel arbors carrying sets of cutting knives through which webbed material may be drawn and severed into elongated strands. A slide cartridge is coupled at its opposite ends to one of the arbors and a force transmitting device, all of which are arranged to be simultaneously and selectively slid in opposite axial directions. Axial force is applied to the force transmitting device by a detachable torque wrench which urges the sets of knives into positive cutting engagement. Movemment in the reverse direction drives opposite sides of the knives into cutting engagement. During shifting of the knives from one mutual cutting position to the other, the web material remains continuously threaded.

19 Claims, 1 Drawing Sheet

TAPE SLITTER ADJUSTMENT MEANS

FIELD OF THE INVENTION

This invention relates to web cutting machines and more particularly to a tape slitter module with rotary knives.

BACKGROUND OF THE INVENTION

Slitters are used for cutting rolls of web material such as magnetic tape into thin strands. Gangs of rotary knives are well known for continuously cutting web material into multiple thin ribbons, the width of which may be varied by changing the spacing between adjacent sets of cutting edges.

An example of prior art in the field is U.S. Pat. No. 4,428,265 granted Jan. 31, 1984, owned by Industrial Tools Inc. of Ojai, Calif. This invention is, in some aspects, an improvement over the "Tape Slitter Axial Loading System" disclosed in the patent.

In a typical conventional slitting process, a large roll of tape is advanced through various mechanisms and treatments. To achieve satisfactory results, the tape must be maintained in alignment and held under a predetermined tension depending on the material, cutting pressure applied and other factors. At different sequential phases, the tape is drawn through nip and tension rollers, moved over guide rollers, advanced by drive rollers, slit and passed through cleaning stations—before the resulting multiple strands are rewound on a packing spool.

In some conventional rotary slitters with parallel arbors, it is known to use both cutting edges of the saws. However, there are disadvantages in attempting to switch from engaging one set of cutting edges to the other set of cutting edges during a continuous tape slitting process. For example, the slitting operation must be stopped and the web material is broken which causes slack throughout the drawn section of the roll. At least one of the arbors must be entirely dismantled from the slitting machine or module and prepared for installation. When the removed arbor is finally reassembled, so the opposite cutting edges of the knives are brought into engagement, the web material must be rethreaded manually through the slitter and tension must be restored. This is time consuming, wasteful and inefficient.

The tape slitting adjustment means and process of this invention is an improvement over conventional slitters as well as the one shown in U.S. Pat. No. 4,428,265 and provides unique features for avoiding the operating difficulties and undesired results encountered by conventional systems.

SUMMARY OF THE INVENTION

This invention comprehends a tape slitter adjustment means and process that can be used for continuously slitting tape and switching from one set of cutting edges to another quickly, efficiently and without breaking the web material.

In its broader aspects, the dual arbor slitter of this invention includes first and second arbors carrying sets of laterally spaced circular knives arranged to project into the spaces defined by one another. Movement control means coupled to one of the arbors can be operated to selectively slide it in opposite axial directions between a first cutting position where one set of cutting edges are urged into positive contact and a second cutting position where the opposite cutting edges are urged into positive cutting contact.

Web material such as magnetic tape is drawn through the first and second sets of circular knives and held under predetermined tension. The movement control means is arranged relative to the circular knives in a manner such that when the moving arbor is axially slid between its first and second cutting positions, the web material is held in its predetermined path alignment.

The movement control means includes a slide cartridge coupled to one end of the first arbor. Force transmitting means is connected to the slide cartridge and both are arranged for simultaneous axial sliding movement with the first arbor.

An adjustable housing is connected to the support frame and is formed with a cavity positioned to retain movement of the slide cartridge and is formed with a bore to guide movement of the force transmitting means. The force transmitting means may be a threaded driver arranged in axial alignment with the first arbor and positioned with its inner end connected to the slide cartridge.

Force applying means is detachably connected to the force transmitting means and may be a manually adjustable torque wrench. A lock nut is connected to the threaded driver and is engageable with the adjustable housing to secure the threaded driver in selected positions while maintaining positive cutting contact between the circular knives.

Height adjustment means is provided to selectively vary the distance between the axes of the first and second arbors and thus allow compensation for wear experienced by the circular knives. The height adjustment means may be in the form of set screws bearing on the top of the adjustable housing and a shim removably positioned beneath the adjustable housing.

From a process standpoint, the present invention involves the steps of providing a pair of parallel gangs of knives with opposite sides forming dual edges, and, drawing web material between the gangs of knives. One gang of knives is axially shifted from a first cutting position where the cutting edges are in contact to a second cutting position where the opposite cutting edges are in contact. As the gangs of knives are relatively moved between their first and second cutting positions, the web material is simultaneously maintained under continuously unbroken and threaded.

BRIEF DESCRIPTION OF THE DRAWINGS

The benefits and unique aspects of this invention will be better understood when the following detailed description is studied in conjunction with the drawings in which.

DETAILED DESCRIPTION OF THE PREFERRED EMBODIMENT

Figure 1:
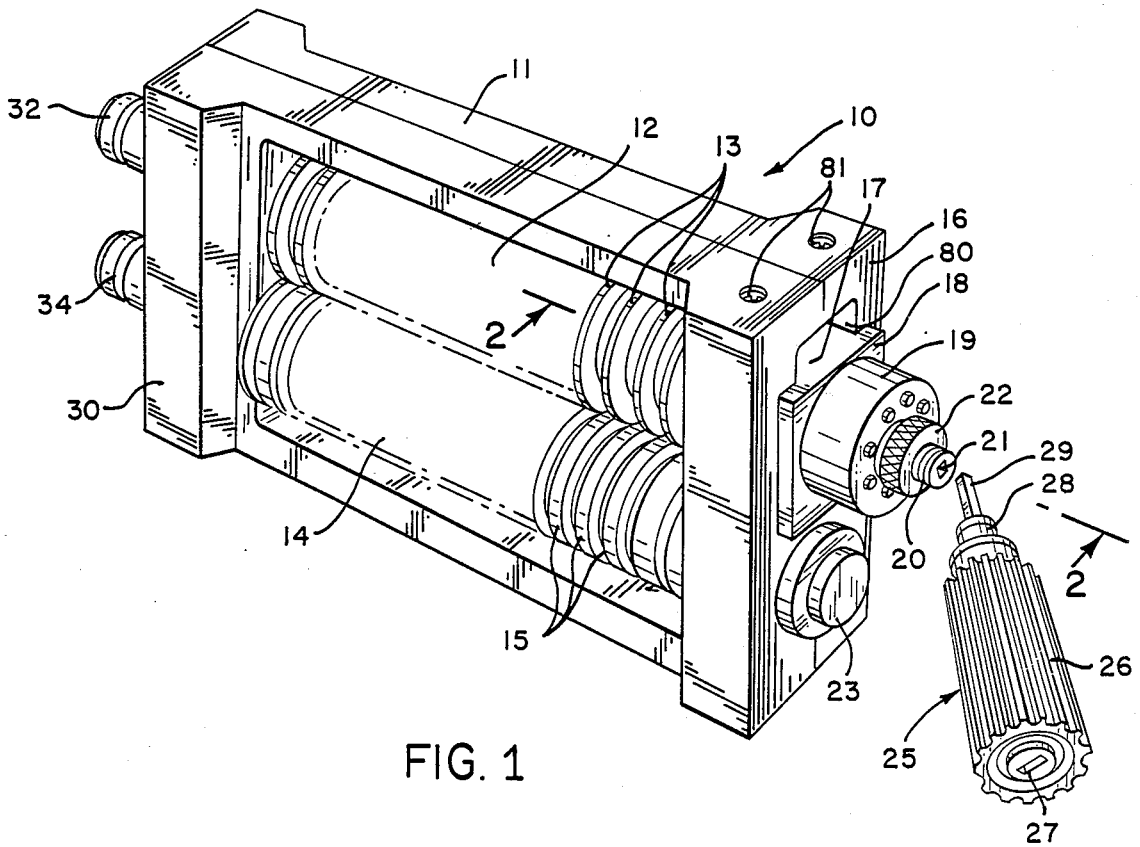
FIG. 1 is a perspective view of a tape slitter module incorporating the double cutting edge adjustment mechanism of this invention and showing force transmitting means to one side of the module.

Referring to FIG. 1 there is shown a slitter 10 constructed to assist in slitting a web of material such as magnetic tape into multiple strands. In fact the slitter 10 is shown in the form of a module for insertion into a machine positioned in a system designed to slit web material held under tension and drawn longitudinally through various work stations and treatments.

Slitter 10 has a sectional support frame 11 shaped to rotatably mount an upper arbor with a plurality or gang of circular knives 13 and a lower arbor 14 with a plurality or gang of circular knives 15. Frame right end 16 is recessed and sized to receive and mount an adjustable housing 18 that includes an end cap 19. Adjustable housing 18 is arranged to be non-rotatable and prevented from axial sliding. Force transmitting means shown in the form of a threaded driver 20 projects externally of adjustable housing 18 and is formed at its free end with an axial socket 21. An adjustable lock nut 22 is shown threadably engaged with threaded driver 20 and bearing against end cap 19. An end plug 23 is coupled to the lower portion of frame right end 16 and assists in mounting and positioning lower arbor 14.

External force applying means in the form of a torque wrench 25 is shown spaced from the force transmitting means 20. Torque wrench 25 is of conventional construction and has a handle 26 and a top end that mounts a torque setting adjustment device 27 which allows a predetermined torque to be set, as measured in inch pounds, for example. A scale or dial 28 is provided to visually indicate the torque magnitude. Drive shaft 29 will no longer rotate within torque wrench 25 when the set torque is exceeded. Axial socket 21 is sized to receive drive shaft 29 and be rotated until the set torque is reached.

The support frame left end 30 is formed with bores and equipped with journal ball bearing assemblies for rotation of the left end 32 of upper arbor 12 and the left end 34 of lower arbor 14. Arbor ends 32 and 34 are designed to be rotated separately or simultaneously by any conventional drive mechanism such as a chain drive sprocket. Such rotation, in normal operating circumstances, causes the engaged circular knives 13 and 15 to slit a web of tape into multiple strands.

The recess formed in frame right end 16 is sufficiently large to allow vertical movement of housing 18 within a relatively narrow gap 80. Height adjustment means that includes set screws 81 is provided to vary the distance between the axes of upper arbor 12 and lower arbor 14. This is accomplished periodically by the person operating slitter 10 to compensate for mutual wear on the knives 13 and 15. Set screws 18 exert downward pressure against the top wall 17 of adjustable housing 18 to maintain the desired relative vertical positioning of circular knives 13. Holding pressure is likewise exerted on the top of the left end of housing 18 by symmetrically positioned set screws (not shown). The internal height adjustment means allows an operator to compensate for wear of the knives 13 and 15 without removing them from the slitter module 10.

Figure 2:
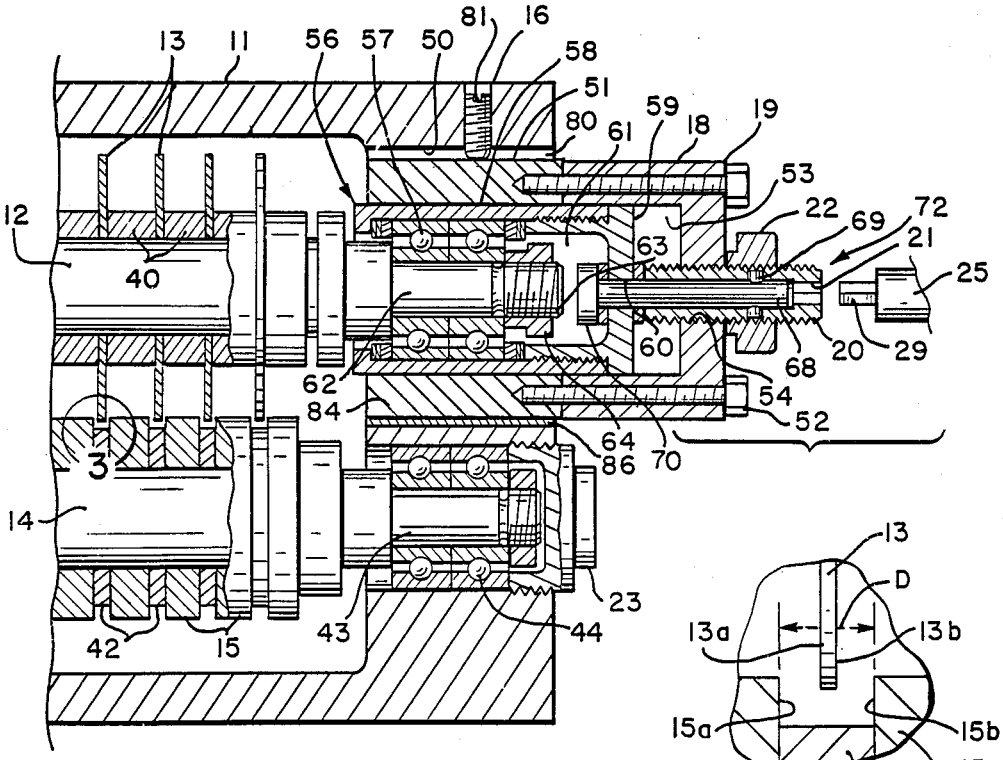
FIG. 2 is a fragmentary cross section of the slitter module with certain portions shown in full lines, taken generally in the direction of the arrows 2—2 of FIG. 1; and, FIG. 3 is a greatly enlarged fragmentary view, partly in cross section, of that portion of the upper and lower circular knives enclosed within the circular section of FIG. 2.

Referring now primarily to FIG. 2, upper arbor 12 carries a gang of circular knives 13 separated by spacers 40 which precisely maintain equal lateral distances between knives 13. Similarly, lower arbor 14 carries a gang of circular knives 15 separated by spacers 42 which precisely maintain equal lateral distances between knives 15. Whereas knives 13 are relatively thin in comparison with their spacers 40, lower circular knives 15 are relatively thick in comparison with their spacers 42. When the respective knives are brought into engagement for cutting action, upper knives 13 are caused to flex slightly to achieve the predetermined cutting pressure. The upper arbor 12 and lower arbor 14 are mutually parallel and arranged so upper knives 13 and lower knives 15 project into the lateral spaces defined by one another. Lower arbor 14 is aligned with its right end 43 journalled in ball bearing assembly 44 and held in axial position in part by end plug 23.

Frame right end 16 is formed with an opening for generally positioning the adjustable housing 18. A sleeve portion 51 of housing 18 is positioned in frame right end 16 and detachably secured to an end cap 19 by bolts 52. A cylindrical cavity 53 is defined by housing 18 and a slide cartridge 56. A threaded bore 54 formed in end cap 19 is in axial alignment with upper arbor 12.

Slide cartridge 56 is mounted within adjustable housing 18 for axial movement with upper arbor 12. Slide 56 includes a ball bearing assembly 57 and a cylindrical casing 58 with a removable end wall 59 formed with an axial bore. A space 61 is formed within end wall 59.

Upper arbor 12 has its right end 62 journalled in ball bearing assembly 57 and is formed with a threaded tip section 63. A lock nut 64 is fastened to threaded tip section 63 to assist in mutually securing arbor 12 and slide 56 and assuring simultaneous axial movement as a unit.

Threaded drive 20 includes a connecting rod 68 anchored at a central location by transverse locking pin 69. Connecting rod 68 passes through axial bore 60 and is formed with an enlarged head 70 positioned in space 61. Threaded driver 20 is fixed to slide 56 by way of the connection between rod 68 and casing end wall 59.

The height adjustment means also includes a shim 86 removably positioned in a shallow slot defined by support frame 11 and a lower wall section 84 of adjustable housing 18. Over the lifetime of the knives, their diameters become reduced from wear and adjustment is likely to be required between 50–100 times. As the circular knives 13 and 15 thus wear down from usage, the adjustment can be achieved to continue with slitting operations without actually dismantling upper arbor 12 or removing it from the slitter module 10. Adjustment of the circular knives can be easily achieved by loosening the set screws 81 and sliding the shim 86 laterally out of slitter module 10. The shim is replaced by a thinner one so arbor 12 can be lowered by a predetermined distance to establish the correct mutual cutting height. When set screws 81 are again tightened, cutting operations may be resumed. In practice, a plurality of set screws and shims would be employed on both the left and right hand sides of slitter module 10.

Together slide 56 and threaded driver 20 constitute a movement control means 72 for axially shifting in either direction arbor 12. Movement control means can be used to axially slide arbor 12 when drive shaft 29 is thrust into socket 21 and torque wrench 26 is manually operated. The applied torque from torque wrench 25 is transmitted through driver 20 to the slide 56 which causes predetermined axial sliding. The sets of arbor knives 13 and 15 are forced into contact with a predetermined degree of cutting pressure in preparation for slitting web material.

Figure 3:
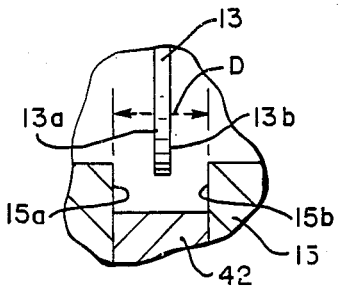

Referring to FIG. 3, the upper circular knives 13 have opposing cutting edges 13*a* and 13*b*. The lower circular knives 15 have opposing cutting edges 15*a* and 15*b*. An upper knife 13 is shown projecting into the space between lower knives 15 and above spacer 42, the lateral distance being indicated by D. Referring to FIGS. 2 and 3, when arbor 12 is thrust to the left, then cutting edges 13*a* and 15*a* are forced into contact. When axially unloaded by movement of arbor 12 in the opposite direction, cutting edges 13*b* and 15*b* can likewise be forced into contact for cutting purposes. All of this may be accomplished rapidly and without requirement to dismantle either arbor or any component of slitter module 10.

OPERATION

Keeping the above construction and procedure in mind, it can be understood how previously described disadvantages of conventional slitter systems are overcome or substantially eliminated by this invention.

Prior to using the invention embodied by slitter module 10, a jumbo roll of web material is mounted on a dispensing spool and a front segment is drawn through the various sequential treatment stations as the web material is properly oriented and subjected to a predetermined tension. Slitter module 10 is designed for slitting plastic tape, such as magnetic tape, video recording tape, computer tape and any high quality instrumentation tape.

The width of the longitudinal strands to be severed from the web material is controlled in part by the widths of the upper and lower spacers 40 and 42, that are stacked alternately with corresponding knives 13 and 15 and can be removed from their arbors and substituted with other precision spacers of varying widths.

With web material adequately tensioned and inserted between upper and lower arbors 12 and 14, it may be continuously drawn through the gangs of knives 13 and 15 and be slit into multiple ribbons. Torque wrench 25 is adjusted to a predetermined ideal torque as indicated on scale 28 and drive shaft 29 is penetrated into socket 21. Clockwise rotation gradually shifts driver 20 and slide 56 axially to the left, with reference to FIGS. 2 and 3, until cutting edges 13*a* are forced into contact with cutting edges 15*a*. Continued application of torque, transmitted to circular knives 13 and 15 is stopped automatically when the preset torque is attained. Thereafter lock nut 22 is rotated forwardly to secure the desired cutting pressure.

In the continuous slitting process, one or both of the arbors 12 and 14 are driven and the web material is continuously pulled over the mating cutting edges and severed into multiple ribbons of predetermined widths.

Eventually the cutting edges 13*a* and 15*a* will become relatively dull, require servicing or otherwise need to be inactivated for purposes of maintaining cutting quality standards. In essence, the adjustment procedure is simply reversed. Lock nut 42 is loosened and torque wrench 25 is rotated counterclockwise to axially unload the cutting pressure between the gangs of knives 13 and 15. Torque is applied until upper arbor 12 is axially shifted to the right and opposite edges 13*b* of circular knives 13 are driven into engagement with the opposite edges 15*b* of lower circular knives 15. When the predetermined torque which controls the cutting pressure is again reached, lock nut 22 is tightened and the slitting procedure is continued. As the knives become worn and are resharpened, the operator may periodically lower arbor 12 by adjusting the set screws 81 and replacing the shims 86 with thinner ones. This maintains the desired cutting action without the need to dismantle or remove the arbors to repair or replace them, as is the conventional procedure.

The time required to switch from one set of cutting edges to the opposite set, is minimal and therefore interruption in production is light. Importantly, during this time only minimal web material is wasted and it remains oriented and unruptured so continuous production can be quickly resumed.

By way of contrast, in conventional continuous tape slitting systems, when it is desired to switch from one set of cutting edges to the other, it becomes necessary to first completely laterally sever the webs so one arbor can be dismantled and thereafter rearranged. This disrupts the orientation and destroys the tension of the web material which must thereafter be re-established by tedious and time consuming hand feeding and rethreading operations.

The invention embodied by the slitter module 10 effectively provides double sets of cutting edges that can be activated and brought into positive cutting engagement quickly and efficiently by avoiding the customary need to dismantle one arbor and cause slack in the web material.

While slitter module 10 has been described for purposes of illustration as particularly constructed for slitting plastic "tape" material, it may also be used in producing multiple longitudinal strands from various other web materials such as stainless steel and other metals, ceramics, fiber board, paper, fiberglass or various combinations of materials. While material may be selected and varied to suit technical and production requirements, the circular knives 13 and 15 are preferably fabricated of solid high grade tungsten carbide, the spacers 40 and 42 of tungsten carbide and the arbors 12 and 14 of tool steel.

From the foregoing it will be evident that this invention has provided a greatly improved slitter module with adjustment means and slitting procedure to achieve many benefits.

We claim:

1. A process of tape slitting, comprising the steps of:

(a) providing a pair of parallel gangs of knives with each knife of each gang having first and second axially opposite cutting edges;

(b) drawing web material between the gangs of knives;

(c) axially shifting one gang of knives from a first cutting position where the first cutting edges on the knives of said one gang are in positive cutting contact with the first cutting edges on the knives of the other gang to a second cutting position where the second cutting edges on the knives of said one gang are in positive cutting contact with the second cutting edges on the knives of said other gang; and (d) simultaneously maintaining constant tension in the web material as the gangs of knives are relatively moved from their first and second cutting positions.

2. A dual arbor slitter comprising:

(a) a support frame;

(b) a first arbor mounted for rotation by the support frame and carrying a first set of laterally spaced circular knives, each of said first set of knives having first and second axially opposed cutting edges;

(c) a second arbor mounted for rotation by the support frame and carrying a second set of laterally spaced circular knives, each of said second set of knives having first and second axially opposed cutting edges, the first and second arbors being parallel and arranged with the first and second sets of circular knives projecting into lateral spaces defined by one another; and (d) movement control means coupled to said first arbor for selectively sliding it in opposite axial directions directly between a first cutting position where said first cutting edges of said first and second sets of cutting knives are urged into positive cutting contact and a second cutting position where said second cutting edges of the first and second sets of cutting knives are urged into positive cutting contact.

3. The structure of according to claim 2, wherein:

(a) a web material is provided and is drawn through the first and second sets of circular knives under predetermined tension, the sets of circular knives and movement control means being arranged so when the first arbor is axially slid between the first and second cutting positions, the web material holds its tension.

4. The structure according to claim 2, wherein:

(a) the second set of circular knives are laterally separated from one another by spacers; and (b) the first set of circular knives are thinner than the second set of circular knives and slightly flexible, and, are laterally separated by spacers comparatively thicker than the spacers separating said second set of knives.

5. The structure according to claim 2, wherein the movement control means includes:

(a) a slide mounted in the support frame and coupled to one end of the first arbor; and (b) force transmitting means connected to the slide, both being arranged for simultaneous axial sliding movement with the first arbor.

6. The structure according to claim 5, including:

(a) a housing connected to the support frame, formed with a cavity positioned to retain movement of the slide and formed with a bore to guide movement of the force transmitting means; and, (b) an end wall formed by the slide, connected to the force transmitting means.

7. The structure according to claim 6, wherein:

(a) said bore is threaded; and (b) said force transmitting means includes a threaded driver in axial alignment with the first arbor, positioned with its inner end connected to said slide end wall and its outer end threadably engaged with and projecting externally of said bore.

8. The structure according to claim 7, including:

a lock nut connected to the threaded driver, engageable with the housing to secure the threaded driver in selected positions and maintain positive cutting contact between circular knives.

9. The structure according to claim 5, including:

force applying means detachably connected to the force transmitting means.

10. The structure according to claim 9, wherein:

the force applying means is a manually adjustable torque wrench; and the force transmitting means is a threaded driver, arranged for rotation in either direction to cause the first arbor to be selectively moved in opposite axial directions.

11. The structure according to claim 10 including:

locking means for securing the threaded driver in selected threaded positions.

12. The structure according to claim 5 including:

height adjustment means for selectively varying the distance between the axes of the first and second arbors.

13. The structure according to claim 12 wherein:

a housing is connected to the support frame and formed with a cavity positioned to retain movement of the slide;

wherein the height adjustment means includes set screws bearing on the top of the housing and a shim removably positioned beneath the housing.

14. A dual arbor slitter comprising:

(a) a support frame;

(b) a first arbor rotatably coupled to support frame carrying a first set of laterally spaced circular knives, each of said first set of knives having first and second axially opposed cutting edges;

(c) a second arbor rotatably coupled to the support frame carrying a second set of laterally spaced circular knives, each of said second set of knives having first and second axially opposed cutting edges, the first and second arbors being parallel and arranged with the first and second sets of circular knives projecting into lateral spaces defined by one another;

(d) a slide cartridge coupled to one end of the first arbor;

(e) force transmitting means connected to the slide cartridge, both being arranged to selectively shift the first arbor in opposite axial directions and positively urge the first arbor between a first cutting position with said first cutting edges of said first and second sets of cutting knives into positive cutting contact and a second cutting position with said second cutting edges of said first and second sets of cutting knives into positive cutting contact;

(f) an adjustable housing connected to the support frame, formed with a cavity positioned to retain movement of the slide cartridge and formed with a threaded bore to guide movement of the force transmitting means;

force applying means detachably connected to the force transmitting means;

whereby the force applying means and force transmitting means are arranged to coact and axially slide the first arbor in one direction to said first cutting position, and, selectively axially slide the first arbor in the opposite direction to said second cutting position.

15. The structure according to claim 14 wherein:

web material is provided and drawn through the first and second sets of circular knives under predetermined tension to produce strands: and the sets of circular knives and slide cartridge are arranged so when the first arbor is actually slid between first and second cutting positions, the web material and strands remain threaded and unbroken.

16. The structure according to claim 14, wherein:

(a) said force transmitting means is a threaded driver in axial alignment with the first arbor, positioned with its inner end connected to said slide cartridge and its outer end engaged with and projecting externally of the adjustable housing threaded bore; and (b) the force applying means is a manually adjustable torque wrench.

17. The structure according to claim 16, including:

locking means for securing the threaded drive in selected positions and maintaining positive cutting contact between circular knives.

18. The structure according to claim 14, including:

height adjustment means for selectively varying the distance between the axes of the first and second arbors in order to compensate for wear on the circular knives.

19. The structure according to claim 18, wherein the height adjustment means includes:

set screws bearing on the top of the adjustable housing: and a shim removably positioned beneath the adjustable housing.

* * * * *